United States Patent [19]

Oka et al.

[11] 4,254,203

[45] Mar. 3, 1981

[54] DRY PROCESS DEVELOPING METHOD EMPLOYING MAGNETIC TONER

[75] Inventors: Tateki Oka; Susumu Tanaka, both of Sakai, Japan

[73] Assignee: Minolta Camera Kabushiki Kaisha, Japan

[21] Appl. No.: 925,699

[22] Filed: Jul. 17, 1978

[30] Foreign Application Priority Data

Jul. 27, 1977 [JP] Japan ..... 52/906720

[51] Int. Cl.[3] ..... G03G 9/14; G03G 13/09

[52] U.S. Cl. ..... 430/120; 430/110; 430/111; 430/122; 252/62.53; 252/62.54

[58] Field of Search ..... 427/14, 18; 252/62.1 P, 252/62.1 PM, 62.53, 62.54; 96/15 D; 430/110, 111, 120, 122

[56] References Cited

U.S. PATENT DOCUMENTS

| | | | |
|---|---|---|---|
| 2,890,968 | 6/1959 | Giaimo | 427/18 |
| 3,124,457 | 3/1964 | Schwertz | 427/18 |
| 4,082,681 | 4/1978 | Takayama et al. | 427/18 |
| 4,111,823 | 9/1978 | Kobayashi et al. | 427/18 |
| 4,142,981 | 3/1979 | Bean et al. | 430/111 |

FOREIGN PATENT DOCUMENTS

| | | | |
|---|---|---|---|
| 2447223 | 4/1975 | Fed. Rep. of Germany | 427/18 |
| 2648258 | 4/1977 | Fed. Rep. of Germany | 252/62.1 PM |
| 50-90335 | 7/1975 | Japan | 252/62.1 PM |
| 51-26046 | 3/1976 | Japan . | |

*Primary Examiner*—John D. Smith

*Attorney, Agent, or Firm*—Wenderoth, Lind & Ponack

[57] ABSTRACT

A dry process developing method which comprises:

(a) preparing main particles comprising a highly insulating resin and magnetizable fine particles, with part of the magnetizable fine particles being exposed through the surfaces of the main particles, (b) preparing subordinate particles having a diameter smaller than that of the main particles and comprising a resin having frictional charging characteristics approximately equal to that of the resin constituting the main particles, (c) admixing said main and subordinate particles to form a developing material wherein said subordinate particles adhere to the portion of magnetic particles exposed through the surface of the main particles; and (d) applying the developing material onto an electrical potential pattern formed on a recording medium for developing the electrical potential pattern into a visible image.

23 Claims, 7 Drawing Figures

DRY PROCESS DEVELOPING METHOD EMPLOYING MAGNETIC TONER

BACKGROUND OF THE INVENTION

The present invention relates to electrophotography and more particularly, to a dry process developing method in electrophotography in which disadvantages inherent in the conventional dry process developing methods, for example, two component developing method employing non-magnetizable toner particles and magnetizable carrier material, and one component developing method employing magnetizable toner particles are eliminated.

Generally, two component developing methods such as the cascade developing method, magnetic brush developing method, etc., are well known in the art and have been put into practical application. In such developing methods, electrically insulating non-magnetizable toner particles having average particle diameters of 10 to 15 μm and particles commonly known as carriers are mixed for use. In the cascade developing method, the non-magnetizable toner particles are charged through rubbing against the electrically insulating carrier particles of bead-like shape to be attracted onto surfaces of the carrier particles and transported to a developing position of a developing apparatus, while in the magnetic brush developing method, the carrier is formed into magnetizable particles mainly of iron of approximately 75 μm in diameter to be magnetically attracted in the form of magnetic brush bristles onto an outer cylinder or sleeve of a developing apparatus in a known manner. In the magnetic brush developing method, the non-magnetizable toner particles are charged through friction against the carrier to adhere to the surfaces of the carrier particles and transported to the developing position in the similar manner as in the cascade developing method mentioned earlier. The electrically conductive carrier particles also serve as a developing electrode positioned extremely close to a photosensitive member during developing.

The dry process two component developing method as described above, however, has various problems particularly related to the carrier in that such carrier only serving in charging and transporting the non-magnetizable toner particles or as the developing electrode (in the case of the magnetic brush developing method) without directly engaging in the developing itself is not consumed at each time of copying, and thus gradually deteriorates with the increase of the number of copies taken, generally making it necessary to be replaced after a predetermined number of copies has been taken. Although the life of the carrier seems to have been prolonged to a considerable extent due to recent development of carriers having various coatings, replacement thereof is still required after use for a predetermined period of time. Furthermore, since the mixing ratio of the carrier to the non-magnetizable toner largely affects the quality of copied images, giving rise to adhesion of the carrier to the photosensitive member in some cases, stabilization of the mixing ratio i.e., replenishing of the non-magnetizable toner at a constant rate is required. Although various improvements have conventionally been proposed for such stabilization of the mixing ratio to be put into practical application, the constant rate replenishment is still difficult, with the developing apparatus tending to be undesirably large in size. Particularly, when the particle size of the carrier is too small or the mixing ratio is deviated to the carrier side, the carrier may adhere onto the surface of the photosensitive member in some cases, thus adversely affecting the quality of the copied images. Moreover, since the diameter of the carrier particle can not be made excessively small due to the above fact, increase of the surface area of such carrier particle is inevitably limited, and depending on the mixing ratio of the carrier to the non-magnetizable toner, there are cases where uneven charging for the non-magnetizable toner may take place.

For eliminating the inconveniences as described above, there has also conventionally been proposed a magnetic brush developing method, for example, in Japanese Patent Publication Tokkaisho 52/65443, wherein high resistance toner particles and magnetizable low resistance toner particles included in the developing material are subjected to triboelectric charging so that the high resistance toner particles are charged with polarity opposite to that of the electrostatic latent image, while the low resistance toner particles are charged with the same polarity as that of the electrostatic latent image, and by a magnet member which attracts the magnetizable low resistance toner particles through magnetic force weaker than the electrostatic attraction produced between the high and low resistance toner particles as a result of said triboelectric charging, the developing material is maintained in the form of magnetic brush which contacts the surface of the electrostatic latent image for developing such latent image into a visible toner image. The known method as described above, however, is not perfectly free from the drawbacks as described earlier, still having some problems to be solved.

In order to overcome the disadvantages inherent in the two component developing method as described above, there has conventionally been proposed one component developing methods employing magnetizable toner particles and the like, for example, in Japanese Patent Publication Tokkaisho 51/26046 in which only magnetizable toner particles having magnetizable fine particles exposed to surfaces thereof are employed for developing an electrostatic latent image of negative polarity formed on a photosensitive member of zinc oxide, and also in Japanese Patent Publication Tokkaisho 51/126836 in which there is employed a developing material constituted by attracting electrically conductive fine particles of approximately 0.01 to 2 weight% onto surfaces of particles which are a mixture of magnetizable fine particles and thermoplastic resin. Some of such conventional one component developing methods have already been put into actual use with direct type copying apparatuses, i.e., copying apparatuses which use photosensitive paper applied with photosensitive material without effecting transfer. Meanwhile, various other attempts have also been made to apply the one component developing method to the copying apparatuses of transfer type, but in such prior art as described above, there are difficult problems to be solved related to physical properties in the developing and transfer in that conditions contrary to each other i.e., electrical conductivity during developing and electrical insulation during transfer are simultaneously required. More specifically, while the developing is successful in the case of the electrically conductive, magnetizable toner particles having high electrical conductivity, there is a disadvantage such that during electric field transfer onto plain copy paper, the polarity of the magnetizable toner is varied due to injection of charge thereto from the copy paper, thus resulting in the phenomenon so-called "Blow-off" in which the toner once transferred onto the copy paper again leaves the same copy paper to cause non-uniform density and fogging or turbulence in the copied images.

For eliminating the undesirable non-uniform density and fogging or turbulence in the copied images as described above, there have conventionally been proposed various arrangements such as employment of electrically insulated copy paper (disclosed, for example, in Japanese Patent Publication Tokkaisho 50/117435), pre-heating of copy paper (disclosed, for example, in Japanese Patent Publication Tokkaisho 50/43936), and uniform exposure of photosensitive surface to light before or during transfer (disclosed, for example, in Japanese Patent Publications Tokkaisho 51/26044 and Tokkaisho 51/96332), etc., none of which is, however, related to improvement of the one component developing method.

On the contrary, the electrically insulating magnetizable toner particles have problems related to developing. More specifically, since such electrically insulating magnetizable toner particles are not sufficiently stable in charging, the developed images tend to be undesirably soiled, and for eliminating such disadvantages, auxiliary means, for example, means for subjecting the electrically insulating magnetizable toner to corona charging within the developing apparatus is required as disclosed in Japanese Patent Publication Tokkaisho 50/117432, thus resulting in complication in the structure of the developing apparatus.

Although a developing method employing magnetizable toner having properties intermediate the electrically conductive magnetizable toner and the electrically insulating magnetizable toner has also been conventionally proposed, for example, in Japanese Patent Publication Tokkaisho 50/92137, it is quite doubtful whether such magnetizable toner can satisfactorily provide the properties of the electrically conductive magnetizable toner and electrically insulating magnetizable toner, while problems arise in such magnetizable toner from the viewpoints of difficulty in manufacturing thereof, stability under various temperatures and humidity conditions, etc.

Another disadvantage inherent in all one component magnetizable toner particles is such that due to the necessity for employing magnetizable material, cost of the toner tends to be high, and that since it is hard to increase the ratio of resin in such magnetizable toner particles, there is a difficulty in fixing thereof.

SUMMARY OF THE INVENTION

Accordingly, an essential object of the present invention is to provide an improved dry process developing method for electrophotography in which disadvantages inherent in the conventional dry process two component developing method and one component developing method are eliminated for efficient copying operation.

Another important object of the present invention is to provide an improved dry process developing method as described above which can be readily applied to conventional transfer type electrophotographic copying apparatuses for obtaining clear and definite copied images without any fogging or turbulence.

A further object of the present invention is to provide an improved dry process developing method as described above which employs a developing material having simple structure and stable functioning so as to be readily manufactured in a large quantity at low cost.

In accomplishing these and other objects, according to the present invention, the dry process developing method for electrophotography comprises the steps of mixing main particles including at least highly insulating resin and magnetizable fine particles, with part of said magnetizable fine particles being exposed through the surface of said main particles, and subordinate particles having diameter smaller than that of said main particles and including at least a resin having frictional charging characteristics approximately equal to that of the resin constituting said main particles to form developing material, and applying said developing material onto an electrical potential pattern or electrostatic latent image formed on a recording medium for developing said electrical potential pattern into a visible image.

The developing method according to the present invention as described above is particularly characterized in that:

(a) The resins constituting the main particles and the subordinate particles, which may be of the same material, have triboelectric or frictional charging characteristics approximately equal to each other, and thus are hardly charged through friction therebetween.

(b) The magnetizable fine particles are exposed to the surfaces of the main particles.

(c) The resins constituting the main particles and subordinate particles are triboelectrically charged to polarity suitable for the development by frictionally contacting the magnetizable fine particles.

Accordingly, in the developing method of the present invention, favorable effects as follows can be achieved.

(i) The subordinate particles are attracted onto the magnetizable fine particle exposed portion of the main particles through coulombic force resulting from the frictional charging so as to form secondary particles described in detail later, and since the secondary particles have insulating properties and each of the resins constituting the main and subordinate particles have electrical charges due to the frictional charging, transfer from the photosensitive surface to copy paper can positively be effected with the use of a conventional corona discharging means.

(ii) In the developing, it is quite possible that the magnetizable fine particle exposed portions of the main particles come into contact with each other due to detaching or deviation of the subordinate particles from the magnetizable fine particle exposed portions of the main particles through external mechanical forces applied to said secondary particles during such developing. Therefore, bristles of the magnetic brush at the developing position become comparatively electrically conductive, thus making it possible to develop images of good quality free from the so-called edge effect.

Owing to the favorable effects as described in the above items (i) and (ii), the present invention has following advantages over the conventional two component developing methods and one component developing methods.

(A) Advantages of the present invention over the conventional dry process two component developing methods:

Since both of the main and subordinate particles, which are the components of the developing material, are utilized for the developing, stable development is effected at all times, without deterioration and the like of the developing material, and thus, maintenance work such as replacement of carrier required in the conventional two component developing methods has been dispensed with.

(B) Advantages of the present invention over the conventional dry process one component developing methods:

Since the toner powder image can be positively transferred with the use of the known corona discharging means, the developing method of the present invention is readily applicable to transfer type electrophotographic copying apparatuses without requiring installation of any particular devices for the development.

These and other objects and features of the present invention will become apparent from the following description taken in conjunction with the preferred embodiment thereof with reference to the accompanying drawings, in which;

FIG. 1 is a schematic diagram explanatory of the structure of a developing material employed in a dry process developing method according to the present invention, FIG. 2 is a fragmentary schematic diagram explanatory of developing phenomenon according to the dry process developing method of the present invention, FIG. 3 is a fragmentary schematic diagram explanatory of transfer phenomenon according to the dry process developing method of the present invention.

FIG. 4 is a schematic side sectional view of a magnetic brush type developing apparatus equipped with a developing material supplying tank to which the dry process developing method according to the present invention may be applied, FIG. 5 is a similar view to FIG. 4, but particularly shows a modification thereof, FIG. 6(*a*) is a schematic side sectional view of an arrangement for statically measuring resistance values of the main particles and subordinate particles of the developing material employed in the present invention, and FIG. 6(*b*) is a schematic side sectional view of an arrangement for dynamically measuring resistance values of the main particles and subordinate particles of the developing material employed in the present invention.

Before the description of the present invention proceeds, it is to be noted that like parts are designated by like reference numerals and symbols throughout several views of the accompanying drawings.

DETAILED DESCRIPTION OF THE INVENTION

In a dry process developing method according to the present invention, there is employed, as developing material, a mixture of two kinds of particles i.e., first and second particles as described hereinbelow. The first particles include at least highly electrically insulating resin and magnetizable fine particles (and coloring agent if necessary), with part of the magnetizable fine particles being arranged to be exposed to surfaces of the first particles. Such first particles will be referred to as main particles hereinbelow. Meanwhile, the second particles having diameter smaller than that of said main particles include at least resin having frictional charging characteristic approximately equal to that of the resin constituting the main particles (and coloring agent if necessary). Such second particles will be referred to as subordinate particles hereinbelow.

The resins employed for the main and subordinate particles may be of the same material, and should preferably have resistivity higher than $10^{14}$ Ω.cm, while average particle diameters of said main particles and subordinate particles should preferably be 5 to 30 μm and 1 to 15 μm respectively.

The resins employable for the main particles and subordinate particles include the polystyrene resin, polyamide resin, polyacrylate resin, polymethacrylate resin, polyvinyl chloride resin, fluoro resin, etc. which are thermoplastic synthetic resins, epoxy resin, acrylic resin, phenolic resin, etc. which are thermosetting synthetic resins, and rosin, gilsonite, etc. and modifications thereof which are natural resins. Meanwhile, materials which may be used for the magnetizable fine particles include magnetite, γ hematite, blood red, chrome oxide, nickel ferrite, manganese, iron, cobalt, nickel alloys, etc. On the other hand, for the coloring agent, carbon black, furnace black, channel black, oil black, phthalocyanine blue, nigrosine and various other coloring agents may be employed. Moreover, it is possible to use magnetizable material such as magnetite simultaneously as coloring agent.

Figure 1:
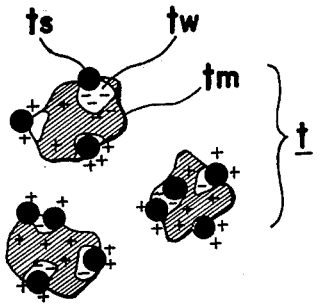

Referring now to the drawings, there is shown in FIG. 1 a schematic diagram explanatory of structure of developing material t employed in a dry process developing method according to the present invention. In FIG. 1, resins of the same material are employed for the main particles tm and the subordinate particles ts, and white portions tw in each of the main particles tm represent portions whereat the magnetizable fines particles (not shown) contained in said main particle tm are exposed. These particles tm and ts preliminarily mixed with each other and suitably stirred are accommodated in a hopper H (FIG. 4) for being supplied onto a known developing cylinder or sleeve Ds of a developing device D (FIG. 2) described in more detail later. In the course of the preliminary mixing and stirring or during transportation from the hopper H to a developing position Dv on the developing sleeve Ds of the developing device D as described above, the particles tm and ts are frictionally or triboelectrically charged to each other or between the main particles tm or subordinate particles ts. Since the resins constituting the main particles tm and subordinate particles ts are of the same material, almost no charging takes place by the friction therebetween, but the resin of the subordinate particles ts and the magnetizable fine particle exposed portions tw of the main particles tm are respectively charged through friction either negatively or positively according to the order of the particles ts and portions tw in frictional charging rows. More specifically, if a resin ranking higher in the frictional charging rows than the magnetizable fine particles constituting the main particles tm is employed for forming the subordinate particles ts, the resin portion of the main particles tm and the subordinate particles ts are positively charged, while the magnetizable fine particle exposed portions tw of the main particles tm are negatively charged. Accordingly, the subordinate particles ts are attracted to the magnetizable fine particle exposed portions tw of the main particles tm by the coulombic force, and several pieces of the subordinate particles ts adhering to one piece of the main particles tm form the so called secondary particle as shown in FIG. 1. Therefore, it is preferable for achieving stable electrical charging that the resins constituting the subordinate particles ts and the magnetizable fine particles contained in the main particles tm are away from each other as far as possible in the frictional charging rows so as to be sufficiently charged through friction therebetween. Meanwhile, in the state of the secondary particles as described above, the magnetizable fine particle exposed portions tw mainly contributing to the electrical conductivity in the main particles tm are covered by the subordinate particles ts as shown in FIG. 1, thus the developing material t presenting electrically insulating nature.

Figure 2:
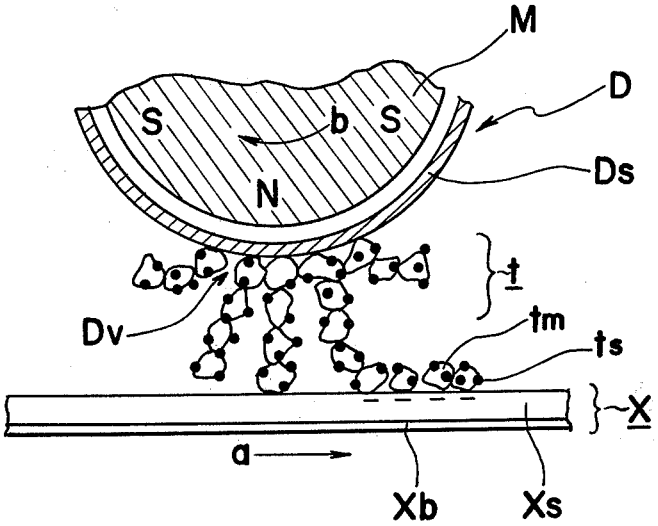
Figure 4:
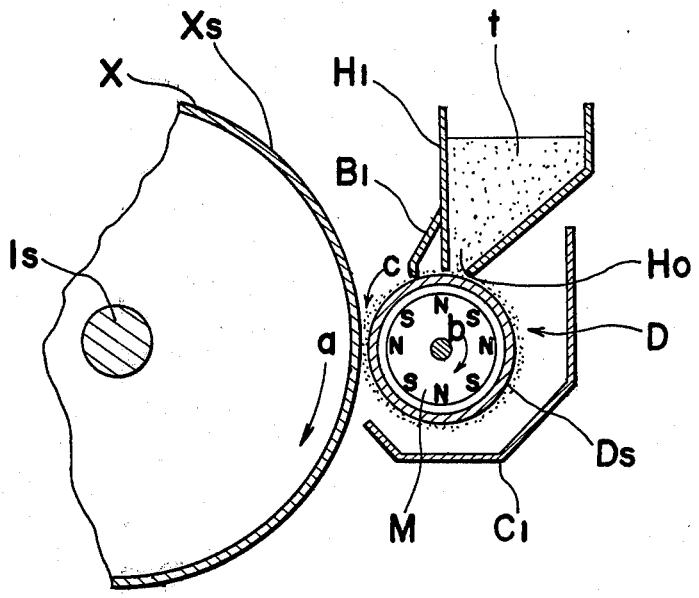

Referring particularly to FIGS. 2 and 4, the process in which an electrical potential pattern or electrostatic latent image formed on a recording medium, i.e., a photosensitive member or photoreceptor X is developed into a visible image by the developing material t composed of the two kinds of particles, i.e., the main particles tm and subordinate particles ts as described above will be described hereinbelow.

In FIGS. 2 and 4, there is schematically shown a known magnetic brush developing device D to which the dry process developing method according to the present invention may be applied. The developing device D generally includes the stationary outer cylinder or sleeve Ds of electrically conductive non-magnetizable material enclosed in a housing $C_1$ and fixedly disposed adjacent to the photoreceptor X which may be in the shape of a drum and composed of a photosensitive layer or surface Xs formed on an electrically conductive base Xb and which is movable or rotatable in the direction of the arrow a about a shaft ls by suitable driving means (not shown), a magnet roller M having a plurality of magnetic poles and rotatably accommodated in said sleeve Ds for rotation in the direction of the arrow b, a toner supplying tank or hopper $H_1$ accommodating therein the developing material t and provided above and adjacent to the outer sleeve Ds for supplying the developing material t onto the sleeve Ds through an opening $H_0$ formed at the bottom portion of said hopper $H_1$, and a magnetic brush height restricting plate $B_1$ extending downwardly from one wall of the hopper $H_1$ toward the surface of the sleeve Ds for restricting the height of the brush bristles formed on the sleeve Ds and transported in the direction of the arrow c as the magnet roller M rotates within the sleeve Ds.

On the photosensitive layer Xs of the photoreceptor X, an image of an original to be copied (not shown) is preliminarily formed in the known manner in the form of the electrostatic latent image of negative polarity for movement toward right in FIG. 2 as the photoreceptor X is moved in the direction of the arrow a. Meanwhile, the magnet roller M is driven by suitable means (not shown) for rotation clockwise in the direction of the arrow b within the sleeve Ds, and developing material t including the main particles tm and subordinate particles ts and supplied through the opening $H_0$ of the hopper $H_1$ is transported in the direction of the arrow c, as the magnet roll M rotates, over the sleeve Ds to a developing position Dv whereat the sleeve Ds confronts the surface of the photosensitive layer Xs. At the developing position Dv, the main particles tm containing the magnetizable fine particles form the so-called magnetic brush bristles along the magnetic lines of force due to the magnetic poles of the magnet roller M, with tips of such brush bristles contacting the surface of the photosensitive layer Xs of the photoreceptor X. In the above case, since the resin portions of the main particles tm and the subordinate particles ts have already been charged to positive polarity as described with reference to FIG. 1, both of the main particles tm and subordinate particles ts integrally combined with each other are attracted onto the surface of the photosensitive layer Xs to develop the latent image formed thereon, through the coulombic force acting with respect to the negative charge of the latent image and according to magnitude of the potential of said latent image. During the development as described above, the developing material t is subjected to a large mechanical force at the developing position Dv due to the movement of said developing material arising from rotation of the magnet roller M, movement of the photoreceptor X, etc. Therefore, in the state of the secondary particles described with reference to FIG. 1, it is quite possible that the subordinate particles ts are disengaged or deviated from the magnetizable fine particle exposed portions tw of the main particles tm, and that other main particles tm and such exposed portions tw are brought into contact with each other to form the magnetic brush bristles. Consequently, such brush bristles thus formed are comparatively of electrically conductive nature and act as a favorable developing electrode located very close to the photoreceptor X, thus making it possible to obtain good developed images without the so-called undesirable edge effect.

It should be noted here that in the developing device D of FIG. 4 in which only the magnet roller M is adapted to rotate, with the developing sleeve Ds remaining stationary, the transportation path of the developing material t between the supplying opening $H_0$ of the hopper $H_1$ and the developing position Dv for stirring the developing material t during transportation thereof so as to charge the main and subordinate particles tm and ts through friction therebetween is not set to be particularly long, since such main particles tm and subordinate particles ts have already been sufficiently stirred during the mixing and accommodated in the hopper $H_1$ in the form of the secondary particles described earlier, and that the developing device D of FIG. 4 has approximately the same construction as that of the known arrangements wherein the conventional one component developing material is employed.

Figure 5:
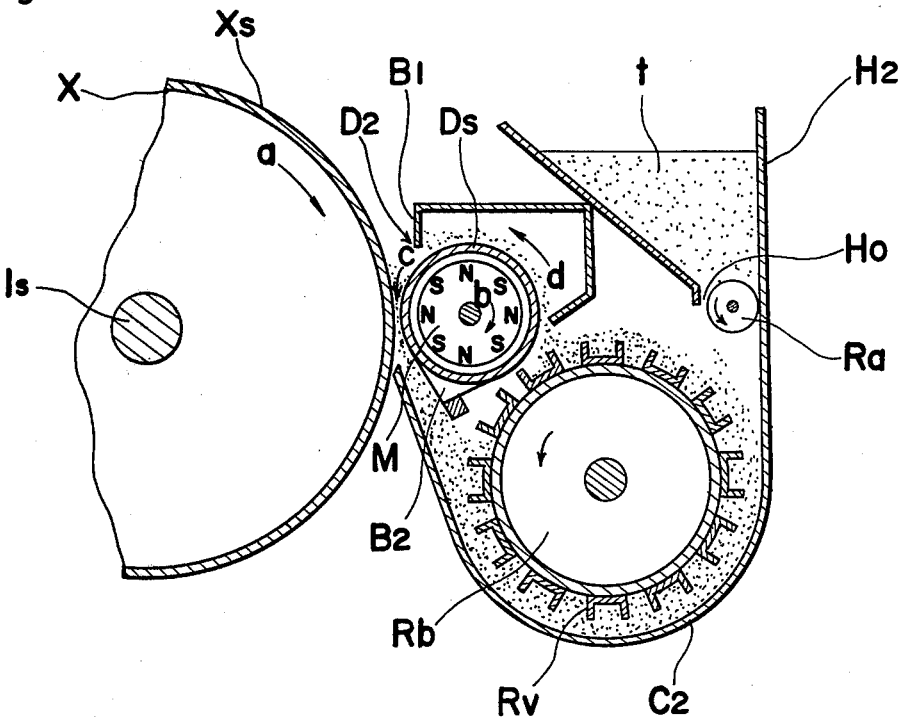

In FIG. 5, there is shown a modification of the developing device D of FIG. 4. In the modified developing device $D_2$ of FIG. 5, the outer sleeve Ds described as stationary in FIG. 4 is arranged to be rotated in the direction of the arrow d, with the magnet roller M also rotating in the direction of the arrow b, while a developing material stirring roller Rb having a plurality of blade-like members Rv radially outwardly extending from the outer periphery thereof is further rotatably provided under the developing sleeve Ds in the housing $C_2$ for further stabilization of the frictional charging between the main particles tm and subordinate particles ts, although such further stirring is not particularly necessary since these particles tm and ts have already been sufficiently stirred during the mixing of the developing material t and housed in a hopper $H_2$ in the form of the secondary particles as earlier described with reference to FIG. 4. In the arrangement of FIG. 5, the hopper $H_2$ for the developing material t is modified to be located above the stirring roller Rb for supplying the developing material t contained in the hopper $H_2$ onto the stirring roller Rb through the opening $H_0$, with a developing material supplying roller Ra rotatably provided in the opening $H_0$. The developing device D of FIG. 5 is further provided with a doctor blade $B_2$ contacting the surface of the outer sleeve Ds at the lower portion of the latter for scraping off the developing material t adhering to the surface of the outer sleeve Ds after the developing. Since other constructions, functions and effects of the developing device $D_2$ of FIG. 5 are generally similar to those of the developing device D of FIG. 4, detailed description thereof is abbreviated for brevity.

As is seen from the foregoing description, it is essential according to the present invention that:

(a) The resins constituting the main particles and subordinate particles should have the frictional charging characteristic approximately equal to each other and may be of the same resin.

(b) The resins constituting the main particles and subordinate particles are charged with the polarity suitable for the developing through frictional contact thereof with the magnetizable fine particles.

It is preferable, however, that conditions as follows are further satisfied in addition to the conditions as described above.

(c) The resins constituting the main particles and subordinate particles should have the same or approximately equal softening point and melting point respectively.

(d) The tones of shade of the coloring agents for the main particles and subordinate particles should be the same or approximately equal to each other.

The above conditions (c) and (d) are required for the reasons as follows.

That is to say, when coloring agents having different tones of shade are employed for coloring the main particles and subordinate particles, not only appearance of the copied images is spoiled, but the copied images available may have different tones of shade depending on variations of the mixing ratio of the main and subordinate particles in the developing material. Therefore, it becomes necessary to separately provide a device for stabilizing the mixing ratio of the main and subordinate particles in the developing material. Meanwhile, if resins having the softening points and melting points apart from each other to a certain extent are employed for constituting the main particles and subordinate particles respectively, there may be encountered such inconveniences, for example, that, in the fixing process, the main particles are hardly melted when the subordinate particles are to be fixed, thus resulting in insufficient fixing or that the temperature is too high for the subordinate particles, although suitable for fixing the main particles and gives rise to the so-called offset phenomenon on a heat roll in the case of a heat roll fixing.

It should be noted that although the resins and coloring agents employed in Examples 1 to 3 mentioned later according to the present invention are of the same material, such resins and coloring agents may not necessarily be of the same material, provided that the foregoing conditions (a) to (d) are met.

Figure 3:
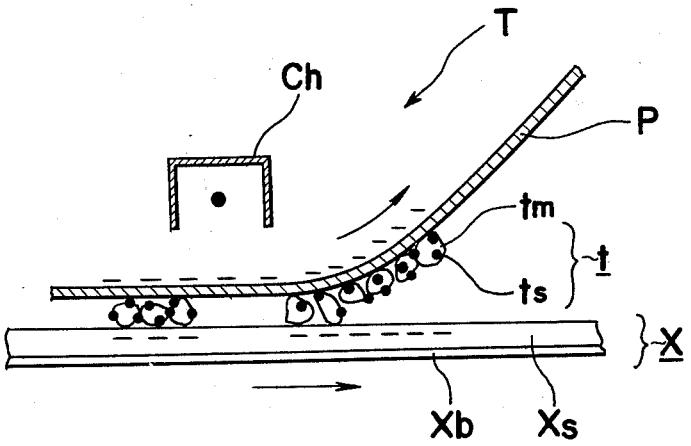

The developing material t adhering to the latent image formed portion on the surface of the photosensitive layer $X_s$ of the photoreceptor X is subsequently transferred onto a copy paper P (plain paper) in a known electrostatic transfer method as shown in FIG. 3.

In FIG. 3, there is schematically shown a main portion of a conventional transfer device T including a transfer corona charger Ch disposed above and adjacent to the photoreceptor X in a position subsequent to the developing device D in the electrophotographic copying apparatus (not shown). The developing material t on the surface of the photosensitive layer Xs is in the form of the secondary particles as described with reference to FIG. 1, and is of insulating nature, since the magnetizable fine particle exposed portions tw of the main particles tm are covered with a subordinate particles ts, and is further sufficiently charged positively. Accordingly, such developing material t is transferred fully efficiently onto the copy paper P passing between the corona charger Ch and the photoreceptor X and negatively charged from its reverse surface by said corona charger Ch. Since the developing material t shows the insulating property as described above, there is no possibility of faulty transfer due to injection of charge through the copy paper P, and therefore, it is unnecessary to use any other transfer supplementing means such as pre-heating means or to employ electrically insulated copy paper and the like.

As is clear from the foregoing description, notwithstanding the fact that the developing material t is constituted by the two kinds of particles, i.e., the main particles tm and subordinate particles ts, these particles tm and ts move integrally in the form of the secondary particles in the developing and transfer processes. Therefore, the developing material t may be treated almost in the similar manner as in the conventional one component magnetizable toner, and simultaneously has desirable features of the known one component magnetizable toner such as reduction in size and simplification of the developing device, and no necessity for replacement of carrier due to deterioration thereof since no carrier is required.

Furthermore, according to the present invention, owing to the peculiar structure of the developing material t in which the main particles tm including at least the resin of highly insulating nature and magnetizable fine particles, with part of the magnetizable fine particles being exposed to the surfaces of the main particles tm, are mixed with the subordinate particles ts having diameter smaller than that of the main particles tm and including at least the resin with the frictional charging characteristic approximately equal to that of the resin constituting the main particles tm, the conditions contrary to each other, i.e. requirements for the electrical conductivity during the developing and the electrical insulation during the transfer, which have been the problems to be solved in the transfer type copying apparatus employing the conventional one component magnetizable toner particles, can advantageously be satisfied. More specifically, in the developing, favorable developed images sufficiently subjected to the electrode effect are obtainable by forming the electrically conductive magnetic brush bristles as described with reference to FIG. 2, while in the transfer, the developing material t is transferred in the efficient manner as stated with reference to FIG. 3.

Furthermore, according to the present invention, since the developing is effected by the use of the developing material including the subordinate particles mainly constituted by the resin, the ratio of the resin in the developing material may be increased higher than in the case where only the magnetizable toner is used, thus improvement of the fixing property of the toner being achieved.

In short, according to the dry process developing method of the present invention, all of the problems encountered in the conventional dry process developing method can be solved, with simultaneous reduction in size and longer life of the developing device, and consequently of the copying apparatus itself.

Subsequently, results of experiments carried out on the basis of the dry process developing method according to the present invention will be given hereinbelow for illustrating the present invention, without any intention of limiting the scope thereof.

It should be noted here that, for manufacturing the main particles, no particular manufacturing process is employed in the following Examples according to the present invention to cause the magnetizable fine particles to be exposed to the surfaces of said main particles. If the main particles are to be produced according to the processes described in the Examples hereinbelow, it is possible to cause the magnetizable toner particles to be exposed to the surfaces of the main particles to an extent which is suitable for the developing method according to the present invention by mixing the resin and the magnetizable fine particles at the approximate weight ratio of 1.0:0.5 to 3.

It should also be noted that in the Examples described hereinbelow, all the experiments were made with respect to the electrostatic latent image of negative polarity unless otherwise stated.

EXAMPLE 1

For main particles:

| | |
|---|---|
| PICCOLASTIC D125 | 39 parts by weight |
| (styrene resin: name used in trade and manufactured by Esso Standard Co., U.S.A.) | |
| MAPICO BLACK | 60 parts by weight |
| ($Fe_3O_4$: name used in trade and manufactured by Columbia Carbon Co., U.S.A.) | |
| Carbon black | 1 part by weight |
| For subordinate particles: | |
| PICCOLASTIC D125 | 92 parts by weight |
| Carbon black | 8 parts by weight |

The above materials were each melted for mixing at the ratio as described above and subsequently subjected to mechanical crushing to obtain the main particles having average diameter of approximately 20 μm and the subordinate particles having average diameter of approximately 10 μm. The main particles and subordinate particles thus obtained were mixed at the weight ratio of main particles: subordinate particles=9:1 for subsequent observation of the mixture under a microscope, and it was noticed that the subordinate particles adhered to the surfaces of the main particles possibly due to the frictional charging between the exposed magnetizable fine particles of the main particles and the subordinate particles. Upon effecting copying operation by a conventional powder image transfer type electrophotographic copying apparatus with the use of the developing material thus obtained, extremely clear and definite copied images were obtained.

It should be noted here that in the above Example 1, the electrostatic latent image developed was of negative polarity as stated earlier, and that when an electrostatic latent image of positive polarity was developed in an additional experiment, with other conditions being equal to those in the Example 1, the resultant copied image had extremely low density, thus not being suitable for actual use, although the developing was effected somehow.

On the other hand, when copying operation was effected by the same copying apparatus as described above with the use only of the main particles of Example 1, the resultant copied images were extremely disturbed, with low transfer efficiency, although the development was almost satisfactorily effected, which result is considered to be attributable to the "Blow off" phenomenon mentioned earlier. It is to be noted that the developing only by the main particles is approximately the same as the known one component developing method put into practical use in the conventional direct type (FAX system) copying apparatuses.

EXAMPLE 2

For main particles:

| | |
|---|---|
| HYMER-SBM-73 | 34 parts by weight |
| (Styrene . acrylic resin: name used in trade and manufactured by Sanyo Chemical Industries, Ltd. Japan) | |
| Iron oxide RB-BL | 64 parts by weight |
| (name used in trade and manufactured by Chitan Kogyo Co., Ltd. Japan) | |
| KETJEN BLACK | 2 parts by weight |
| (name used in trade and manufactured by the Lion Fat and Oil Co., Ltd. Japan) | |
| For subordinate particles: | |
| HYMER-SBM-73 | 92 parts by weight |
| KETJEN BLACK | 8 parts by weight |

In the similar manner as in Example 1, the main particles having average diameter of approximately 15 μm and the subordinate particles having average diameter of approximately 8 μm were obtained, which were subsequently mixed at the weight ratio of main particles: subordinate particles=8:2. Upon effecting copying experiments by the conventional powder image transfer type electrophotographic copying apparatus as employed in Example 1 with the use of the mixture described above, clear and definite copied images were obtained.

Furthermore, resistances of the main particles and subordinate particles in the Example 2 were measured by means of arrangements shown in FIG. 6(*a*) (static measuring method) and FIG. 6(*b*) (dynamic measuring method) as described hereinbelow.

Figure 6A:
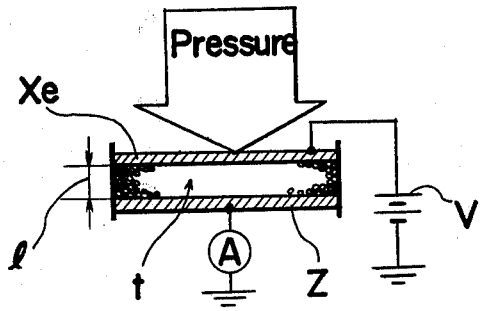
Figure 6B:
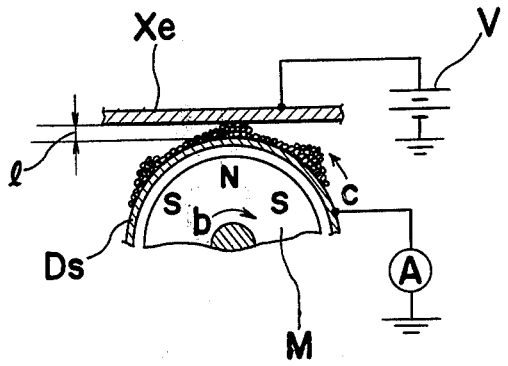

In the static measuring arrangement of FIG. 6(*a*), the particles to be tested for resistance were disposed between a member Xe equivalent to the photoreceptor X and a member Z equivalent to the outer sleeve Ds which were spaced a distance l of 1 mm from each other, with the member X connected to a voltage source V of 500 V and the member Z coupled to the ground through an ammeter (A). By applying a pressure of 2.5 kg/cm$^2$ onto the member Xe, the resistance values were calculated from current values obtained by the ammeter (A).

Meanwhile, in the dynamic measuring arrangement of FIG. 6(*b*), the developing outer sleeve Ds with diameter of 31 mm coupled to the ground through the ammeter (A) and accommodating therein the rotatable magnet roller M was disposed adjacent to the member Xe equivalent to the photoreceptor X and connected to the voltage source V of 500 V, with the distance l between the surfaces of the member Xe and the sleeve Ds being set to be 0.5 mm. As the particles t to be tested for resistance were carried over the sleeve Ds at a speed of 10 cm/sec in the direction of the arrow c during rotation of the magnet roller M, the resistance values were calculated based on the current values read from the ammeter (A).

The results of the above measurements were as follows.

| Particles tested | Tests | Resistance values | Remarks |
|---|---|---|---|
| Main particles only | static | $10^{14}$ Ω . cm | |
| | Dynamic | $5 \times 10^{10}$ Ω . cm | Value per 1 cm in the longitudinal direction of the sleeve Ds. |
| Subordinate particles only | static | Higher than $10^{14}$ Ω . cm | (over the measuring range) |

EXAMPLE 3

For main particles:

| | |
|---|---|
| For main particles: | |
| PICCOLASTIC D125 | 16 parts by weight |
| PICCOTEX LC (Styrene resin: name used in trade and manufactured by Esso Standard Co. U.S.A.) | 16 parts by weight |
| Iron oxide RB-BL | 65 parts by weight |
| KETJEN BLACK | 3 parts by weight |
| For subordinate particles: | |
| PICCOLASTIC D125 | 46 parts by weight |
| PICCOTEX LC | 46 parts by weight |
| KETJEN BLACK | 8 parts by weight |

In the similar manner as in Example 1, the main particles having average diameter of approximately 20 μm and the subordinate particles having average diameter of approximately 5 μm were obtained, which were subsequently mixed at the weight ratio of main particles: subordinate particles=9:1 and 7:3 respectively. Upon effecting copying experiments by the conventional powder image transfer type electrophotographic copying apparatus as employed in Example 1 with the use of the developing material described above, clear and definite copied images were obtained in all of the experiments.

Although the present invention has been fully described by way of examples with reference to the accompanying drawings, it is to be noted that various changes and modifications are apparent to those skilled in the art. Therefore, unless otherwise such changes and modifications depart from the scope of the present invention, they should be construed as included therein.

What is claimed is:

1. A dry process method for developing an electrostatic latent image which comprises:

(a) preparing main particles comprising a highly electrically insulating resin and magnetizable fine particles, part of said magnetizable fine particles being exposed through the surfaces of said main particles;

(b) independently of step (a), preparing subordinate particles having a diameter smaller than that of said main particles and comprising a resin having frictional charging characteristics approximately equal to that of the resin constituting said main particles, (c) mixing said main and subordinate particles to form a developing material wherein said subordinate particles are adhered to the magnetizable particles exposed through the surface of said primary particles, (d) triboelectrically charging said highly electrically insulating resin in said particles to a polarity opposite that of an electrostatic latent image to be developed by frictional contact between said magnetizable particles exposed through the surface of said main particles and said highly electrically insulating resin and (e) applying said developing material onto an electrical potential pattern formed on a recording medium to develop said electrical potential pattern into visible image.

2. A dry process developing method as claimed in claim 1, wherein said resins used for said main particles and subordinate particles are of the same material.

3. A dry process developing method as claimed in claim 1, wherein said main particles have average diameter in the region from 5 to 30 μm, with said subordinate particles having average diameter in the region from 1 to 15 μm.

4. A dry process developing method as claimed in claim 1, wherein resistivity of said resin for said main particles and subordinate particles is higher than $10^{14}$ Ω.cm.

5. A dry process developing method as claimed in claim 1, wherein said main particles further includes coloring agent.

6. A dry process developing method as claimed in claim 1, wherein said subordinate particles further includes coloring agent.

7. A method according to claim 1 wherein the ratio of main to subordinate particles is 9:1-7:3.

8. The method according to claim 1 wherein said magnetic particles and resin are melted together and the resultant product is crushed to form said main particles.

9. The method according to claim 1 wherein the static resistivity of the main particles is higher than the dynamic resistivity of said main particles.

10. The method according to claim 1 wherein the static resistivity of said main particles is about $10^{14}$ Ω.cm or higher.

11. The method according to claim 10 wherein the main particles have a dynamic resistivity of about $5 \times 10^{10}$ Ω.cm.

12. The method according to claim 1 wherein the main particles have an average diameter of 15 μm and the subordiate particles have an average diameter of about 8 μm and the weight ratio of said main to subordinate particles is 8:2.

13. A method for developing an electrostatic latent image which comprises the steps of:

(a) preparing a developing material composed of a mixture of main particles and subordinate particles prepared independently of said main particles, said main particles comprising a highly electrically insulating resin and magnetizable fine particles exposed through the surfaces of said main particles, said subordinate particles having a diameter smaller than that of said main particles and comprising a highly electrically insulating resin having frictional charging characteristics selectively the same as and approximately equal to that of said main particles, said highly electrically insulating resin portion of said main particles and subordinate particles being of a material which can be electrically charged upon frictional contact thereof with said magnetizable fine particles exposed through the surface of said main particles, said subordinate particles adhering to the portions of said magnetic particles exposed through the surface of said main particles, (b) triboelectrically charging said highly electrically insulating resin portion of said particles to a polarity opposite that of the electrostatic latent image to be developed by frictional contact between said magnetizable particles exposed through the surface of said main particles and said highly electrically insulating resin and (c) forming magnetic brush bristles from said developing material and (d) contacting said electrostatic latent image with said brush bristles to thereby develop said latent image to a visible image.

14. An electrophotographic developing method as claimed in claim 13, wherein said main particles and subordinate particles each have tones of color selectively the same as and approximately equal to each other, said resins for each of said main particles and subordinate particles having softening points and melting points selectively the same as and approximately equal to each other.

15. An electrophotographic developing method as claimed in claim 13, wherein said main particles and subordinate particles are of the same resin.

16. An electrophotographic developing method as claimed in claim 13, wherein said main particles have average diameter in the region from 5 to 30 $\mu$m, with said subordinate particles having average diameter in the region from 1 to 15 $\mu$m.

17. An electrophotographic developing method as claimed in claim 13, wherein resistivity of said resins for said main particles and subordinate particles is higher than $10^{14}$ $\Omega$.cm.

18. The method according to claim 13 wherein the ratio of main to subordinate particles is 9:1-7:3.

19. The method according to claim 13 wherein said magnetic particles and resin are melted together and the resultant product is crushed to form said main particles.

20. The method according to claim 13 wherein the static resistivity of said main particles is higher than the dynamic resistivity of said main particles.

21. The method according to claim 13 wherein the static resistivity of said main particles is about $10^{14}$ $\Omega$.cm or higher.

22. The method according to claim 21 wherein the main particles have a dynamic resistivity of about $5\times10^{10}$ $\Omega$.cm.

23. The method according to claim 13 wherein the main particles have an average diameter of 15 $\mu$m and the subordinate particles have an average diameter of about 8 $\mu$m and the weight ratio of said main to subordinate particles is 8:2.

* * * * *

UNITED STATES PATENT AND TRADEMARK OFFICE

CERTIFICATE OF CORRECTION

PATENT NO. : 4,254,203

DATED : March 3, 1981

INVENTOR(S) : Tateki Oka et al.

It is certified that error appears in the above—identified patent and that said Letters Patent is hereby corrected as shown below:

ON THE TITLE PAGE:

Under Foreign Priority Application Data in Item (30), line 2, change "52/906720" to read -- 52/90672 --.

Signed and Sealed this

*Sixteenth* Day of *March 1982*

[SEAL]

*Attest:*

GERALD J. MOSSINGHOFF

*Attesting Officer*

*Commissioner of Patents and Trademarks*